United States Patent [19]

Alexander, Jr.

[11] 4,099,478

[45] Jul. 11, 1978

[54] HIGH THRUST TROLLING MOTOR

[75] Inventor: Charles F. Alexander, Jr., Oshkosh, Wis.

[73] Assignee: Brunswick Corporation, Skokie, Ill.

[21] Appl. No.: 610,304

[22] Filed: Sep. 4, 1975

[51] Int. Cl.[2] ..... B63H 21/28

[52] U.S. Cl. ..... 115/18 E; 74/801

[58] Field of Search ..... 115/18 E, 17, 34 R; 74/785, 801

[56] References Cited

U.S. PATENT DOCUMENTS

| | | | |
|---|---|---|---|
| 2,824,984 | 2/1958 | Harris | 115/18 E |
| 2,950,635 | 8/1960 | Bieger et al. | 74/801 |
| 3,059,505 | 10/1962 | Reicks | 74/801 |
| 3,498,253 | 3/1970 | Wood | 115/18 E |
| 3,628,492 | 12/1971 | Baldwin | 115/17 |
| 3,703,642 | 11/1972 | Balaguer | 115/18 E |
| 3,995,579 | 12/1976 | Childre | 115/18 E |

*Primary Examiner*—Trygve M. Blix
*Assistant Examiner*—Sherman D. Basinger
*Attorney, Agent, or Firm*—Andrus, Sceales, Starke & Sawall

[57] ABSTRACT

An electric trolling motor includes a lower unit with a cylindrical motor housing closed at the aft end by a planetary gear-reduction subassembly including a cup-shaped end bell housing. A motor shaft hub member telescopes into the housing and clamps against an annular gear with clamping bolts passing therethrough and threaded into the hub member. Planetary gears carried by a cage engage the annulus gear. A propeller shaft is fixed to the cage and journaled in a hub portion of the housing. A sun gear meshes with the planetary gears and has an opening aligned with an opening in a hub portion of the hub member to receive the motor shaft. The shaft openings in the gear housing and in the hub member have shaft bearings in spherical seats and rotating seals. The subassembly drops onto the motor shaft with the gear housing abutting the motor housing and secured thereto by bolts. The motor shaft and sun gear have complementing interlocking surfaces to establish rotatable interconnection. The opposing surfaces of the sun gear and the cage have thrust bearing surfaces with the motor shaft holding the sun gear in cage abutting relation. The propeller unit includes a hub which telescopes over the hub portion of the housing which is of the same diameter as the housing to form an extension of the housing to minimize weed entanglement. A pair of large diameter propeller blades project from the hub and are swept back in the direction of rotation.

7 Claims, 4 Drawing Figures

HIGH THRUST TROLLING MOTOR

BACKGROUND OF THE INVENTION

This invention relates to a high thrust trolling motor and particularly to a gear reducing unit forming an integral part of the lower unit.

In the art of trolling, small electric driven outboard motor units are mounted to the transom of a boat and employed for slow speed maneuverability and positioning of the fishing boats. The electric drive motor is housed within the lower unit and coupled to drive a suitable propeller. The electric trolling motor unit may be specially employed in bass fishing and the like where the motor unit is primarily employed for limited maneuverability within a fishing area to properly locate the boat with respect to and positioning of the fishermans lines. The motor unit is turned for steering of the boat by a foot control coupled by push-pull cables to a turning gear means in the head of the motor unit and the speed is similarly controlled from a foot control connected in circuit with a battery and the motor. A separate high powered internal combustion outboard motor is normally provided for rapid propulsion of the watercraft to the fishing location or spot after which the trolling motor is employed. A particularly unique and satisfactory motor unit construction is illustrated in the co-pending application of Charles F. Alexander, Jr. and entitled "PIVOTAL MOUNT ASSEMBLY FOR TROLLING MOTORS" which was filed Sept. 4, 1975 with Ser. No. 610,414 now U.S. Pat. 4,008,680, and is assigned to the same assignee.

Although electric trolling motor units are commercially available, the inventor has found that the known constructions do not provide enough thrust to give the response and degree of control which is often desired. The motors are often designed to operate from the conventional 12 volt battery. Such units have generally produced a maximum static thrust of 15 pounds which reduces to approximately 10 pounds at 3 miles per hour. Similar units designed to operate from a 24 volt supply are also available with a static thrust on the order of 25 pounds which drops to the order of 15 pounds at 3 miles per hour. Although such motors produce a more desirable control because of the higher thrust than the 12 volt models, it is necessary to use two 12 volt batteries with them instead of one.

Generally, direct drive connections of the electric motor to the propeller unit have been provided to establish a simple and reliable trolling motor with minimal cost. Conventionally, trolling motors are operated from the conventional 12 volt battery. Where greater thrust is desired, the motor is designed for energization from a 24 volt source providing the desired increase in horsepower. Although this conventional approach can provide the desired increased thrust, the present inventor has realized that, in fact, the approach does not provide an optimum electric trolling motor, particularly, for low speed operation.

SUMMARY OF THE PRESENT INVENTION

The present invention is particularly directed to high thrust trolling motors and particularly to improved gear coupling for driving a large diameter low RPM propeller. This larger slower turning propeller is more efficient in producing thrust at low boat speeds than the presently used small high speed propellers. The larger propeller requires more torque to turn it and this is provided by the reduction gear between the motor and the propeller. Generally, in accordance with the teaching of the present invention, the trolling motor includes a lower unit within which an electric motor is housed and coupled to a separate propeller drive shaft by a reduction gear means to establish a low speed and large torque to turn the large propeller that produces high thrust. By increasing the diameter of the propeller unit an increase in the static thrust is obtained for a given motor horsepower. More particularly, the static thrust of an electric trolling motor is proportional to the propeller diameter to the two-thirds power and in the same manner the static thrust is proportional to the horsepower to the two-thirds power if the appropriate gear reduction is used between the electric motor and the propeller. Although a gear reduction means must be added to the lower unit, the use of a planetary gear system is uniquely adapted to practical implementation in a low cost trolling motor. The planetary gear system, as is well-known, distributes the load between the planet gears. Consequently, relatively inexpensive plastic, and sintered gear members can be employed.

The propeller blades of a trolling motor are conventionally formed with a sweptback leading edge to minimize weed entanglement. In accordance with a further aspect of this invention, the propeller unit is formed with an enlarged hub essentially corresponding to and forming an extension of the motor and gear housing assembly. This has been found to minimize the weed entanglement when compared to the conventional small propeller hub assembly employed in the conventional direct drive trolling motors.

More particularly, in accordance with particular optimum and novel embodiment of the present invention, the gear reduction means is a planetary gear train or system which is formed as a separate self-contained unit or subassembly to close the corresponding end of the lower unit with a convenient coupling between the propeller shaft and the motor shaft. Generally, in this aspect and feature of this embodiment of the invention the lower unit will include a generally cylindrical motor housing closed at the forward end by a suitable nose fairing unit. The gear subassembly includes an outer end bell housing having a cylindrical portion corresponding to that of the motor housing. The gear housing is generally cup-shaped and provided with the bearing means to accommodate a propeller bearing shaft and bearing assembly. The inner end of the gear housing includes a motor shaft hub member which has an outer diameter generally corresponding to an inner diameter of the gear housing. The planetary gear system includes an annular internally toothed gear which is clamped between the base of the gear housing and the inner end of the hub member. The housing and hub member have opposing faces which are recessed or otherwise formed to define a planetary gear chamber. The propeller shaft is rotatably mounted within the gear end wall, with the inner end thereof staked to a rotating planetary gear cage to which a plurality of planetary gears are rotatably mounted in meshing engagement with the teeth of the annular gear. A sun gear is located in meshing engagement with the planetary gears and includes a motor shaft opening aligned with a motor shaft bearing opening in the hub member.

The gear housing, the annular gear and hub member are clamped together as by suitable bolt means to firmly interconnect the elements as a subassembly with the planetary and sun gears within the gear chamber. The assembly defines an essentially sealed gear chamber which may be filled with a suitable lubricant to establish and ensure long life reliable operation of the drive system.

The subassembly is preferably also provided with bearing members and suitable rotating seals to rotatably support the adjacent ends of the motor shaft and the propeller shaft while absorbing thrust forces exerted thereon. The subassembly includes appropriate means such as axially extended motor bolt openings which permit the clamping of the assembly in abutting engagement with the cylindrical motor starter housing.

In the assembly of the lower unit the planetary gear assembly is attached to the appropriate end of the motor housing and rotated until the incoming motor shaft aligns with the offset coupling opening after which the total assembly is turned to align the clamping openings with the openings in the stator assembly for clamping to permit introduction and tightening of the housing bolts.

Applicant has found that the planetary reduction gear system applied to the trolling motor results in a construction which establishes a high torque at the propeller which permits the use of a large propeller driven at relatively slow rotation which provides more thrust for a given motor horsepower.

BRIEF DESCRIPTION OF THE DRAWING

The drawing furnished herewith illustrates a preferred construction of the present invention in which the above advantages and features are clearly disclosed as well as others that will readily be understood from the following description.

In the drawing.

DESCRIPTION OF ILLUSTRATED EMBODIMENT

Figures 1, 2, 3, 4:
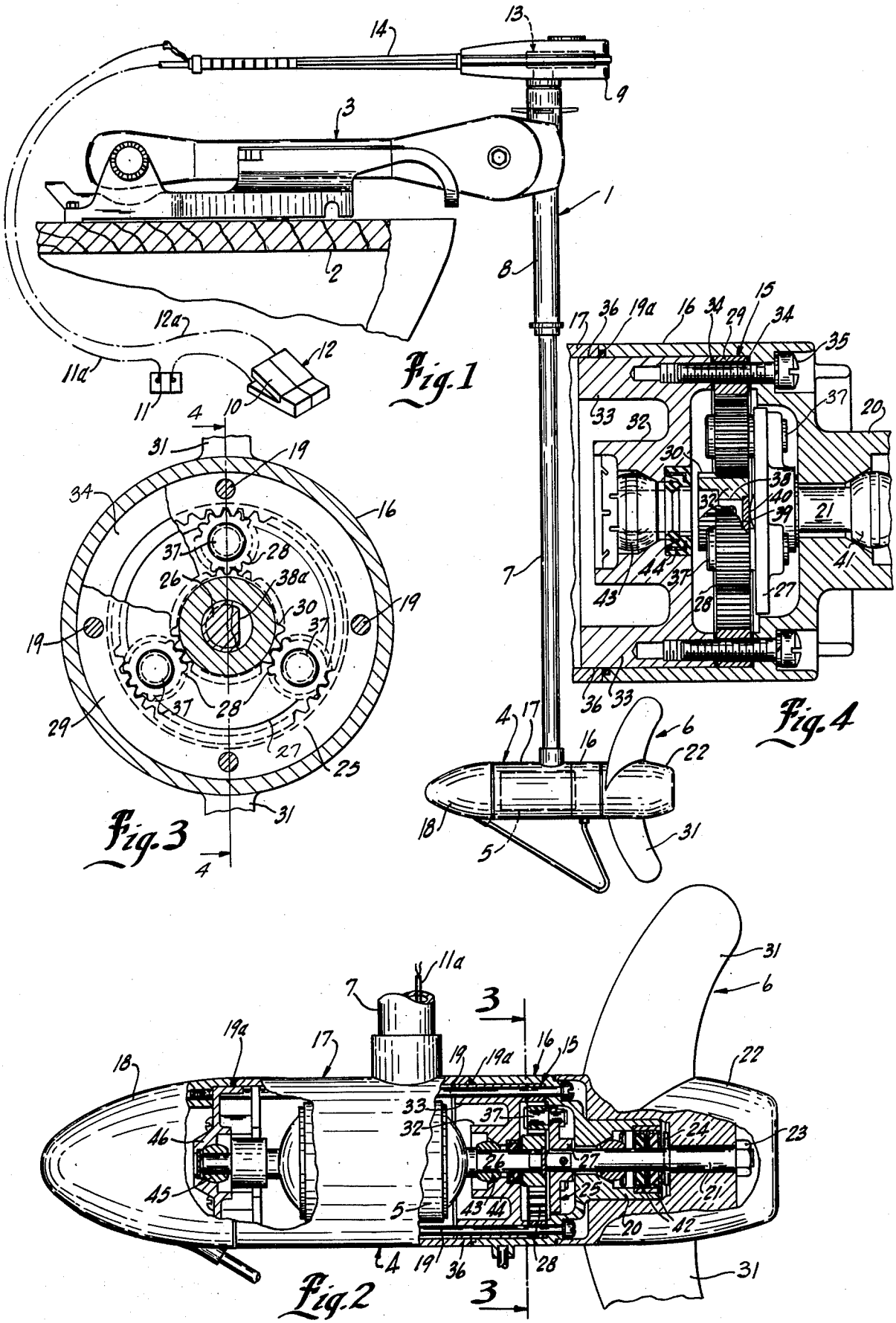
FIG. 1 is a side elevational view of a trolling motor attached to the mounting deck forming a part of a watercraft, not shown.
FIG. 2 is an enlarged side elevational view of the lower units with parts broken away and sectioned to illustrate the construction of one embodiment of the present invention.
FIG. 3 is an enlarged view taken generally on line 3—3 of FIG. 2.
FIG. 4 is a vertical section taken generally on line 4—4 of FIG. 3.

Referring to the drawing and particularly to FIG. 1 a trolling motor 1, particularly adapted for bass fishing and the like, is illustrated mounted to a horizontal support wall 2 which will form the appropriate deck or mounting means of a watercraft, not shown. Generally watercraft for bass fishing includes a forward deck 2 to which the trolling motor 1 is pivotedly secured by suitable pivot assembly 3 for selective positioning of the motor in propelling position shown in FIG. 1. The assembly 3 permits positioning in a raised alternate position lying on the deck 2. Generally the trolling motor 1 includes a lower unit 4 within which a small electric motor 5 is housed and coupled to drive a propeller unit 6. The lower unit 4 is secured to the lower end of a support tube member 7, which may conveniently be a suitable pipe-like member. Supporting pipe 7 is suitably rotatably journaled or mounted in a swivel tube support 8 which terminates at the upper end within a steering housing or head 9. The swivel tube 8 is connected to the pivotal mount assembly 3. The motor 5 is selectively energized from within the boat 2 to vary the speed of propeller 6 and thereby the propulsion forces and the trolling motor 1 is pivoted within the swivel tube 8 from within the boat support to turn the watercraft. Generally, suitable foot control means are employed and are diagrammatically illustrated including a speed control foot unit 10 connected in circuit with a battery II and suitable connecting leads **11*a* which extend through the upper head 9 and down through the conduit or pipe 7 to a suitable control circuit, not shown, for energizing of the motor 5. Similarly, a positioning foot control 12 is connected by a push-pull cable 12*a* to the upper head 9 within which a suitable rack and pinion gear system 13 or the like couples the push-pull cable 12*a* to the upper end of the pipe 7, which terminates within housing 9, for selective rotation thereof. In the illustrated embodiment of the invention, the motor 1 is also provided with an upper handle 14 for selective pivoting and positioning of the motor unit. The motor 5 is coupled to the propeller 6 through a special speed reduction gear unit 15, which in the illustrated embodiment of the invention is formed as a separate subassembly and connected as an integrated end closure to the aft end of the lower unit 4**.

Generally, the illustrated embodiment of the unit 15 includes a cup-shaped gear housing 16 having an outer cylindrical portion corresponding to the diameter of the motor housing 17 to which the supporting conduit 7 is secured. The opposite end of the housing 17 is closed by a suitable nose cone or housing 18. A pair of conventional clamping bolts 19 extend through the several housings 16–17 and thread into the housing 18 to draw the several housing members into firm abutting and clamped engagement. O-ring seals **19*a* are located between the abutting housing sections to create a liquid tight enclosure of the motor and associated equipment. The subassembly and particularly the cup-shaped gear housing 16 further includes a coaxial end hub 20 within which a propeller shaft 21 is rotatably mounted. The hub 22 of the propeller 6 telescopes over the shaft 21 and is locked in position by an outer locking nut 23. A pin 24 extends through the shaft 21 and into an appropriate recess in the propeller hub 22 to further interlock the hub to the shaft for rotation of the propeller 6**.

The inner end of the shaft 21 terminates within the subassembly 15 and is connected by a reduction gear means or train 25 to the motor shaft 26 which extends from the motor 5 and into the subassembly 15 with a releasable slip-type interconnection to the reduction gear train 25.

The gear train 25 is illustrated in a preferred embodiment as a planetary gear means and includes a rotating planetary gear cage 27 which is pinned or otherwise connected to the shaft 21. A plurality of planetary gears 28 are rotatably mounted in meshing engagement with a fixed annulus gear 29 and an inner sun gear 30 to which the motor shaft 26 is coupled. The planetary gear system is uniquely adapted to the present application because it provides a highly efficient and long life with a relatively large reduction ratio. For example, in a practical application employing a 3 inch housing a reduction ratio of 4.2 to 1 is obtained to thereby significantly reduce the rotational output and to establish a large torque output at the propeller unit 6. Further, the propeller unit 6 includes two broad blades 31 of a long radial extent which with the high torque produces a means to slowly and accurately move and position the boat 2. Blades 31 include swept back leading edges with an outer diameter in excess of 7 inches and preferably on the order of 10 inches.

More particularly in the illustrated preferred embodiment of the present invention, the housing 16 is generally cup-shaped member with the outer end or base portion including a reduced diameter hub 20 and the outer connecting portion to the cylindrical portion of housing 16. The cylindrical portion of the cup-shaped housing 16 has an inner diameter sized to receive the annulus gear 29, with such gear abutting an inner annular planar base surface. The annulus gear 29 is clamped to the housing 16 by an inner motor shaft hub member 32 having an outer cylinder portion 33 telescoping in close fitting engagement within the housing 16. Gaskets 34 are disposed to the opposite sides of the annulus gear 29 and the elements are clamped into an integrated unit by a pair of clamping bolts 35 which extend through the outer base of the cup-shaped housing 16, through the gear 29 and the associated gaskets 34 and thread into a suitably taped openings in the cylindrical portions 33 of the hub member 32. The clamping bolts 35 are diametrically located on the assembly and offset 90° from the mounting openings for the motor assembling bolts 19. The cylindrical portion 33 of the hub member 32 may project outwardly from the housing 16 slightly to provide a support and guide portion which projects into the cylindrical motor housing 17, as most clearly shown at 36 in FIGS. 2 and 4. The O-ring seals **19*a* may be provided at the abutting junction therebetween by a small recess provided in the inner corner of the housing 16 immediately adjacent the guide portion 33. The annulus gear 29 is thereby rigidly clamped in position as a fixed gear of the planetary gear train 25**.

The opposing faces of the cup-shaped housing 16 and the hub member 32 are recessed to define a gear chamber within which the planetary gear train 25 is disposed. In particular, the sun gear cage 27 is located within a suitable recess in the cup-shaped housing 16. The cage 27 is shown as a disc-like plate coaxially aligned with the sun gear 30 with the three planetary gears 28 secured to the cage in any suitable manner as by staking or rivets 37 to rotatably support the planetary gears in meshing engagement with the annulus gear 29 and with the sun gear 30. The sun gear 30 is a conventional small circular gear member which mates with the several planetary gears 28 and in the illustrated embodiment is particularly formed with a central stepped opening 38 which is adapted to receive the inner end of the shaft 26 which is correspondingly shaped.

As most clearly shown in FIGS. 3 and 4, the opening 38 and the outer end of the motor shaft 26 are similarly formed with keying portion in the form of an offset chordal locking or keying flat surface **38*a* providing rotational interlock of the shaft 26 to the sun gear 30. The inner end of the opening 38 is shown closed by a thrust washer 39 which abutts a bearing means 40 on the adjacent surface of cage 27. In the illustrated embodiment, the inner end of the propeller shaft 21 projects inwardly slightly from the face of the cage 27 and is rounded to present a bearing surface 40 to the washer 39. In the assembled relation, sun gear 30 is held firmly on the shaft 26 and is coupled thereto by the offset drop opening 38 to transmit the output of the motor 26 through the planetary gear system 25 to the propeller shaft 21. The rotation of the small sun gear 30 results in the rotation of the planetary gears 28 about their own axis, with the meshing with the fixed annulus gear 29 generating a rolling movement thereon about the axis of the sun gear 30 in accordance with well-known functions. The rotary motion is transmitted through the cage 27 to the propeller shaft 21** and thus to the propeller.

In the illustrated embodiment of the invention, shaft 21 is rotatably supported within the hub by a suitable spherical thrust bearing 41 secured within an outer recessed hub portion and which is the subject matter of U.S. Pat. No. 4,009,677, which issued May 1, 1977 from a co-pending application filed Sept. 4, 1975, with Ser. No. 610,303. The outer end of the hub is sealed by a pair of suitable rotary seals 42 of any desired or suitable construction. As such elements are well-known and can be readily provided by the ordinary worker skilled in the art, no further description is given.

Similarly the motor shaft hub member 32 is recessed, with an outer spherical bearing and an inner rotary seal 44 located immediately adjacent to the gear chamber. The opposite end of the motor shaft 26 may be similarly supported by a sealed spherical bearing assembly 45 clamped between the opposite end of the housing 17 and the nose cone housing 18 as at 46.

In the assembly, the planetary subassembly 15 is constructed with the clamping bolts 35 developing an integrated structure. The assembly 15 is dropped over the motor shaft 26, and if necessary, by slowly rotating them relative to each other to align the offset interlocking chordal portion **38*a* with the corresponding portion of the shaft 26 such that the assembly will drop onto and into interlocking engagement. The assembly bolts 19 are then inserted and drawn up tightly with the thrust washer 39 of the sun gear 30 moving into bearing relationship with the inner end of shaft 21 to complete the assembly of the lower unit for receiving of the propeller unit 6. The hub 22 of propeller unit 6 can be dropped onto the assembled unit with the pin 24 aligned with the connecting recess and clamping nut 23** tightened to complete the assembly.

As previously noted the Applicant has found that the planetary gear system 25 provides a highly unique and particularly practical high reduction gear ratio for incorporation in the lower unit of a high torque trolling motor as a part of a mass production process.

A ¼ horsepower electric motor of twelve-volt design can particularly over the very low speed range provide a torque characteristic approaching that of the more conventional 24 volt units and of course providing a highly superior characteristic when compared with the more conventional 12 volt direct coupled electric drive motor. A ¼ horsepower 12 volt motor constructed in accordance with this invention may provide an initial torque of 25 foot pounds, similar to that of the usual 24 volt units, which drops to approximately 10 foot pounds at 3 miles per hour. This is contrasted with the more conventional 12 volt units which generally provides an initial output torque of 15 pounds which decreases therefrom to approximately 10 pounds at 3 miles per hour. During the range of the very low speeds and particularly in the order of 1 mile per hour, the present invention provides a torque which is of generally one-third again as large as the conventional type motor.

The present invention thus provides an improved trolling motor and particularly such a motor adapted for competitive bass fishing and the like. Various modes of carrying out the invention are contemplated as being within the scope of the following claims, particularly pointing out and distinctly claiming the subject matter which is regarded as the invention.

I claim:

1. In an electric trolling motor having a lower unit secured to a tubular depending support, said lower unit including a cylindrical motor housing with an electric motor located therein and closed at the forward end, a generally cup-shaped housing means having an outer cylindrical portion corresponding to the cylindrical motor housing of said motor and having an inner planar base portion adjacent to the outer cylindrical portion, a motor shaft hub member having a cylindrical portion closely fitting within the outer cylindrical portion of the cup-shaped housing and having an inner end, an internally toothed annulus gear located between said base portion and said inner end of the cylindrical portion of the motor hub member, bolt means extending through said base portion and said annulus gear and threaded through said cylindrical portion of said hub member for firmly interconnecting said members, said base portion of said housing means and said hub member having opposed recesses to the opposite side of said annulus gear to define a gear chamber, a reduction gear means located in said chamber and including a planetary gear cage located within the recessed portion of the cup-shaped housing means and having a plurality of planetary gears meshing with the internally toothed annulus gear, a sun gear meshing with planetary gears, a propeller shaft rotatably journaled within said cup-shaped housing means and having the inner end fixed to said cage coaxially of the sun gear, said sun gear having a keying opening with a motor shaft having a keying end projecting therein, and a thrust bearing means between said cage and said sun gear to rotatably support said sun gear.

2. In an electric trolling motor, a lower housing unit having a cylindrical housing with an open end, an electric motor located within said housing and having a motor output shaft, a cup-shaped gear housing having an outer cylindrical portion corresponding to the cylindrical housing of the lower unit with one end open and the opposite end closely by a base portion and having a first shaft opening in the base portion of said housing, a shaft hub member secured in sealing relation within the open end of said gear housing and having a second shaft opening coaxially aligned with said first shaft opening, a planetary gear means within said gear housing and including a pair of coaxially aligned gear coupling means aligned with said shaft openings, said gear housing having mounting means for firmly interconnecting thereof abutting said lower unit cylindrical housing, said planetary gear means includes a fixed internally toothed annulus gear secured between said base portion and said hub member and forming a part of the gear housing, a plurality of planetary gears meshing with said internally toothed annulus gear and secured to a gear cage, a propeller shaft secured directly to said cage and extending outwardly of the first shaft opening in said base portion, a propeller directly mounted on said propeller shaft, a sun gear mating with said planetary gears and having an opening aligned with the second shaft opening in said hub member, said motor output shaft projecting through said second shaft opening and into said opening of said sun gear, and bearing means on said cage aligned with said sun gear to axially support said sun gear.

3. A lower housing unit for connection in the lower unit of a trolling motor having a cylindrical housing with an open end, comprising a cup-shaped gear housing having an outer cylindrical portion corresponding to the cylindrical housing of the lower unit with one end open and the opposite end closed by a base portion and having a first shaft opening in the base portion of said housing, a shaft hub member secured in sealing relation to the open end of said gear housing and having a second shaft opening, a planetary gear means within said gear housing and including a pair of coaxially aligned gear coupling means aligned with said shaft openings, said gear housing having mounting means for firmly interconnecting thereof abutting said lower unit cylindrical housing, said gear means includes a fixed internally toothed annulus gear secured between said base portion and said hub member, a plurality of planetary gear meshing with said internally toothed annulus gear and secured to a gear cage, a propeller shaft secured to said cage and extending outwardly of the first shaft opening in said base portion, a sun gear mating with said planetary gears and having an opening aligned with the second shaft opening in said hub member for releasably receiving of a motor shaft, bearing means on said cage aligned with said sun gear to axially support said sun gear, said base portion and said hub member have telescoping cylindrical portions closely fitting with said annulus gear clamped therebetween, and have sealing means and spherical bearing means in each of said openings in said base portion and said hub member.

4. In an electric trolling motor having a lower submersible propeller unit assembly including a lower submersible cylindrical housing having an aft propeller end, an electric motor mounted within said housing and forming the sole source of motoring power, said motor having a horizontal output shaft with an axis of rotation extending through the propeller end and operated in a selected rotational speed range to develop a selected horsepower output and a propelling speed range, said motor being constructed with a twelve volt supply, a propeller unit coaxially attached to the lower housing and having a propeller shaft with a rotational axis coincident with the axis of the motor and having a plurality of propeller blades of a radial length substantially in excess of the diameter of the housing, a single driving coupling between the electric motor output shaft to the propeller shaft, said driving coupling including a planetary gear reduction means having a gear housing secured to the end of the cylindrical housing of the lower unit and including an input gear means aligned with and affixed directly to the electric motor output shaft, said planetary gear reduction means having an output gear means coaxial of said input gear means and said motor shaft, said propeller shaft being directly affixed to the output gear means and supported immediately adjacent the gear housing, said gear reduction means reducing the speed of the propeller shaft relative to said motor shaft by a reduction ratio of at least 4 to 1 to develop a torque in the order of ten foot pounds with said propelling speed range approximately three miles per hour, a tubular rod-like mounting member secured to said motor housing in spaced relation to said propeller unit and extending therefrom.

5. The trolling motor of claim 4 wherein said blades define a propeller diameter in excess of seven inches.

6. The trolling motor of claim 5 wherein said blades define a propeller diameter on the order of ten inches.

7. The trolling motor apparatus of claim 4 wherein said propeller unit includes a propeller hub and said propeller blades project outwardly from said propeller hub with swept back leading edges and conjointly with said hub minimizing weed entanglement about the propeller unit.

* * * * *

UNITED STATES PATENT AND TRADEMARK OFFICE

CERTIFICATE OF CORRECTION

PATENT NO. : 4,099,478

DATED : July 11, 1978

INVENTOR(S) : Alexander

It is certified that error appears in the above-identified patent and that said Letters Patent are hereby corrected as shown below:

| | | | | |
|---|---|---|---|---|
| Column | 4, | Line | 6, | After "battery" cancel "II" and insert --- 11 ---; |
| Column | 6, | Line | 63, | After "like" begin a paragraph with "Various"; |
| Column CLAIM 2 | 7, | Line | 38, | After "end" cancel "closely" and insert --- closed ---; |
| Column CLAIM 3 | 8, | Line | 12, | Before "meshing" cancel "gear" and insert --- gears ---. |

Signed and Sealed this

*Eleventh* Day of *March 1980*

[SEAL]

*Attest:*

SIDNEY A. DIAMOND

*Attesting Officer*

*Commissioner of Patents and Trademarks*